US005299966A

United States Patent [19]

Rose, III

[11] Patent Number: 5,299,966

[45] Date of Patent: Apr. 5, 1994

[54] PROJECTILE TOY APPARATUS

[76] Inventor: Thomas M. Rose, III, 335 Oak Rd., Gibsonia, Pa. 15044

[21] Appl. No.: 20,358

[22] Filed: Feb. 22, 1993

[51] Int. Cl.[5] ..... A63H 27/00; A63H 27/26; A63H 29/00

[52] U.S. Cl. ..... 446/62; 446/211; 446/429

[58] Field of Search ..... 446/15, 61, 62, 63, 446/64, 66, 34, 429, 176, 211

[56] References Cited

U.S. PATENT DOCUMENTS

| | | | |
|---|---|---|---|
| 2,158,377 | 5/1939 | O'Hare | 446/62 |
| 2,315,242 | 3/1943 | Briggs et al. | 446/63 |
| 3,002,314 | 10/1961 | Brottman | 446/15 |
| 3,408,767 | 11/1968 | Anderson | 446/62 |
| 3,433,210 | 3/1969 | Schnitz | 446/62 X |
| 3,888,178 | 6/1975 | Senoski | 446/63 X |
| 4,038,776 | 8/1977 | Filipeli | 446/429 X |
| 4,714,444 | 12/1987 | Rendel | 446/61 |
| 4,915,664 | 4/1990 | Bakker | 446/62 |
| 5,156,564 | 10/1992 | Hasegawa | 446/34 X |

FOREIGN PATENT DOCUMENTS

| | | | |
|---|---|---|---|
| 2227950 | 8/1990 | United Kingdom | 446/62 |

*Primary Examiner*—David N. Muir
*Attorney, Agent, or Firm*—Leon Gilden

[57] ABSTRACT

A projectile toy includes an elongate body having an internal cavity, to include wing plates that are arranged for pivotment from a first position positioned within the cavity to a second position directed exteriorly of the cavity in a timed relationship to project the wings from the body upon directing the toy from a catapult alone or in combination with a propulsion member.

2 Claims, 4 Drawing Sheets

PROJECTILE TOY APPARATUS

BACKGROUND OF THE INVENTION

1. Field of the Invention

The field of invention relates to toy apparatus, and more particularly pertains to a new and improved projectile toy apparatus wherein the same is arranged to effect spreading of wings to provide for a glide and return relative to projection of the toy structure.

2. Description of the Prior Art

Toy apparatus simulating aircraft structure is indicated in U.S. Pat. No. 4,294,032 wherein a miniature rocket is mounted within a fuselage to open the cover relative to a body member directed therefrom.

U.S. Pat. No. 4,076,006 to Breslow sets forth a toy rocket with a pneumatic launcher associated therewith.

U.S. Pat. No. 3,465,472 sets forth a slingshot type rocket member having a parachute associated therewith.

U.S. Pat. No. 3,831,315 to Gilbert sets forth a toy rocket launching system employing a balloon member.

The instant invention attempts to overcome various components of the prior art in addressing a toy rocket structure to simulate an aircraft shuttle structure employing extensible wings opened subsequent to launching of the aircraft structure and in this respect, the present invention substantially fulfills this need.

SUMMARY OF THE INVENTION

In view of the foregoing disadvantages inherent in the known types of projectile toy apparatus now present in the prior art, the present invention provides a projectile toy apparatus wherein the same is arranged to provide for a toy structure having wing members opened subsequent to launching of the toy projectile structure. As such, the general purpose of the present invention, which will be described subsequently in greater detail, is to provide a new and improved projectile toy apparatus which has all the advantages of the prior art projectile toy apparatus and none of the disadvantages.

To attain this, the present invention provides a projectile toy including an elongate body having an internal cavity, to include wing plates that are arranged for pivotment from a first position positioned within the cavity to a second position directed exteriorly of the cavity in a timed relationship to project the wings from the body upon directing the toy from a catapult alone or in combination with a propulsion member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved projectile toy apparatus which has all the advantages of the prior art projectile toy apparatus and none of the disadvantages.

It is another object of the present invention to provide a new and improved projectile toy apparatus which may be easily and efficiently manufactured and marketed.

It is a further object of the present invention to provide a new and improved projectile toy apparatus which is of a durable and reliable construction.

An even further object of the present invention is to provide a new and improved projectile toy apparatus which is susceptible of a low cost of manufacture with regard to both materials and labor, and which accordingly is then susceptible of low prices of sale to the consuming public, thereby making such projectile toy apparatus economically available to the buying public.

Still yet another object of the present invention is to provide a new and improved projectile toy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
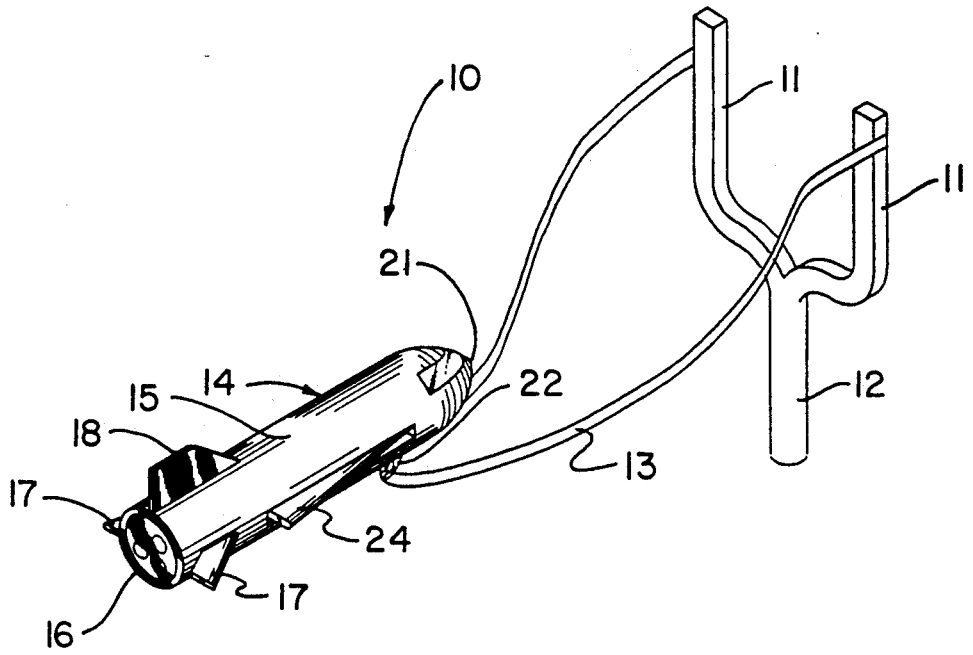
FIG. 1 is an isometric illustration of the invention in use.
Figure 2:
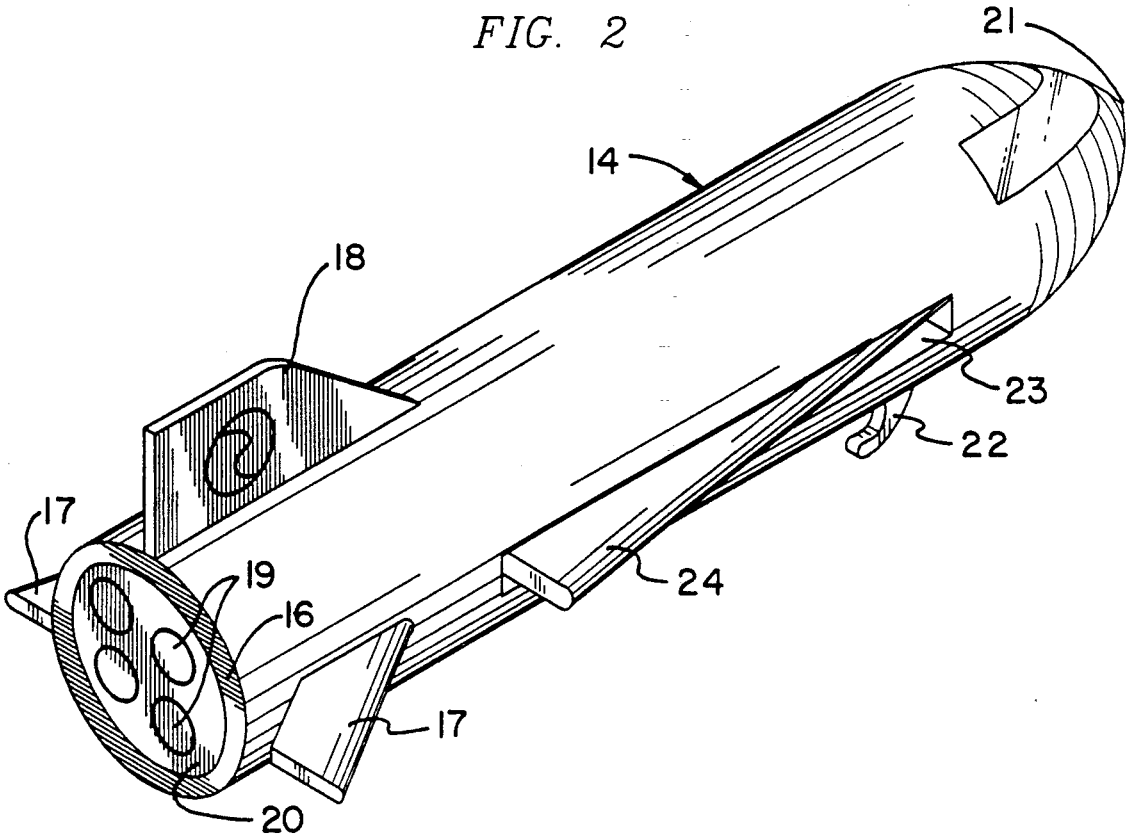
FIG. 2 is an enlarged isometric illustration of the projectile toy structure.
Figure 3:
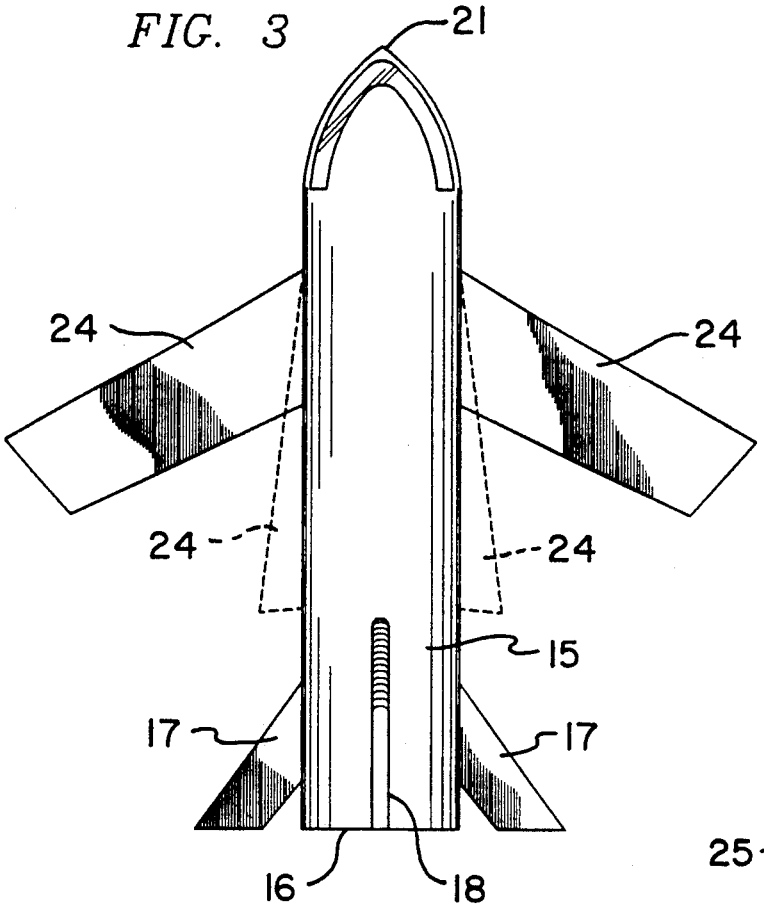
FIG. 3 is an orthographic top view of the projectile toy structure indicating the wings directed into the cavity of the rocket structure.

With reference now to the drawings, and in particular to FIGS. 1 to 7 thereof, a new and improved projectile toy apparatus embodying the principles and concepts of the present invention and generally designated by the reference numeral 10 will be described.

More specifically, the projectile toy apparatus 10 of the instant invention essentially includes use with a slingshot member having spaced slingshot legs 11 mounted to a handle 12. An elastomeric band 13 is mounted to the legs 12 to receive a projectile toy 14 having a cylindrical body 15. The body 15 includes a first end 16 spaced from a conical second end 21. The body 15 includes a plurality of stabilizer fins 17 arranged in a coextensive relationship relative to one another in diametrically opposed sides of the body 15, with a rudder fin 18 mounted medially of the stabilizer fins 17, with the stabilizer fins and rudder fin 17 and 18 respectively mounted adjacent the first end 16. The first end includes a cap member 20 received within the first end, having a plurality of cap member openings 19 for simulation of a rocket member. A body hook 22 is mounted medially of the stabilizer fins 17 diametrically opposed to the rudder fin 18, with a body hook 22 positioned adjacent the second end 21.

Figure 4:
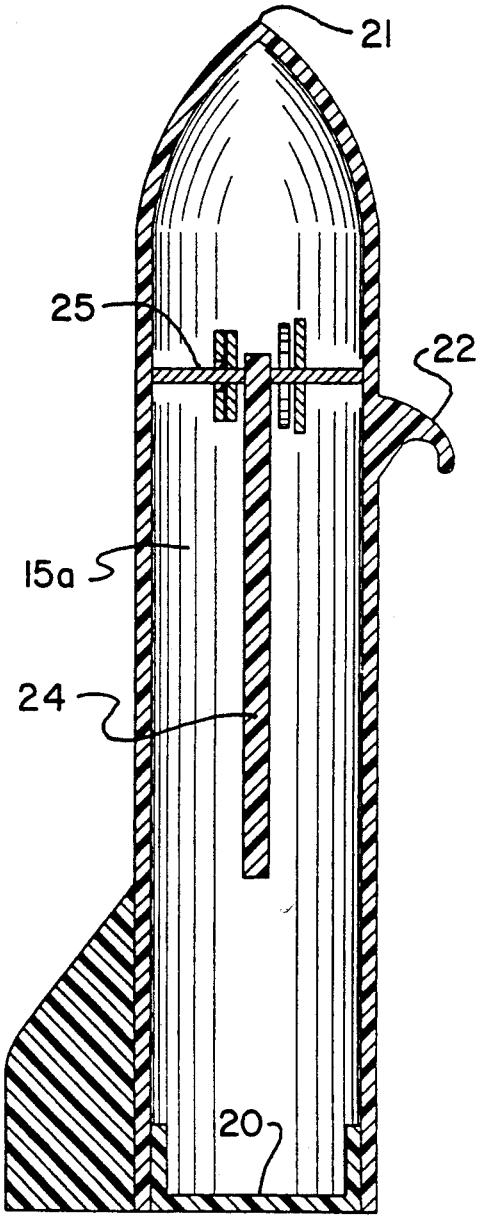
FIG. 4 is an orthographic cross-sectional illustration of the projectile toy having the wings pivotally mounted therewithin.
Figure 5:
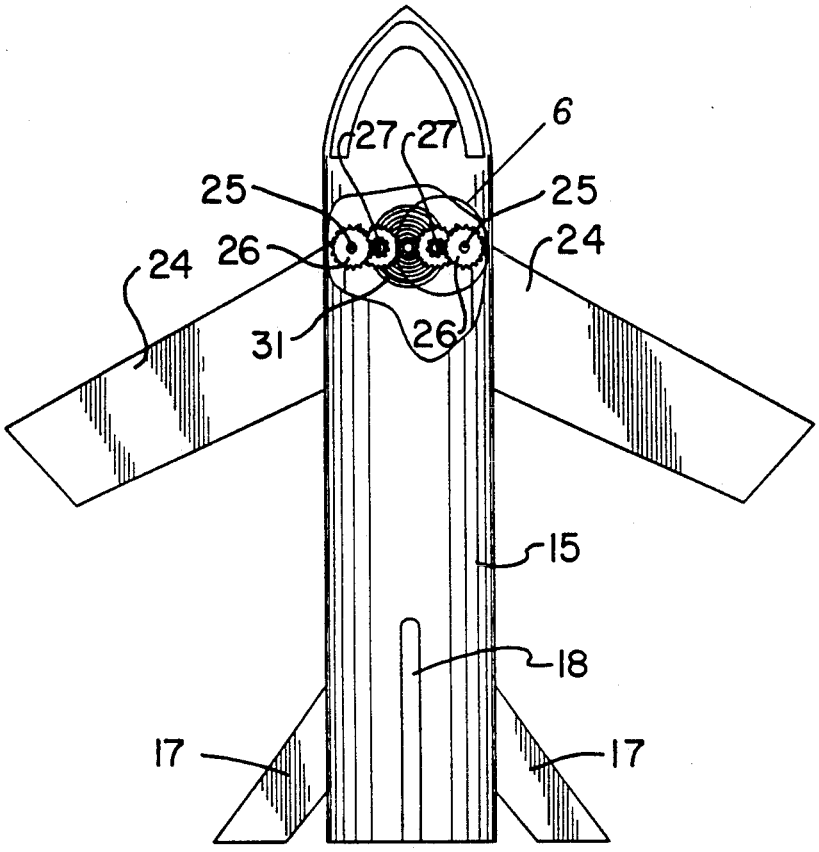
FIG. 5 is an orthographic top view, partially in section, of the timing mechanism of the invention relative to the wing structure.
Figure 6:
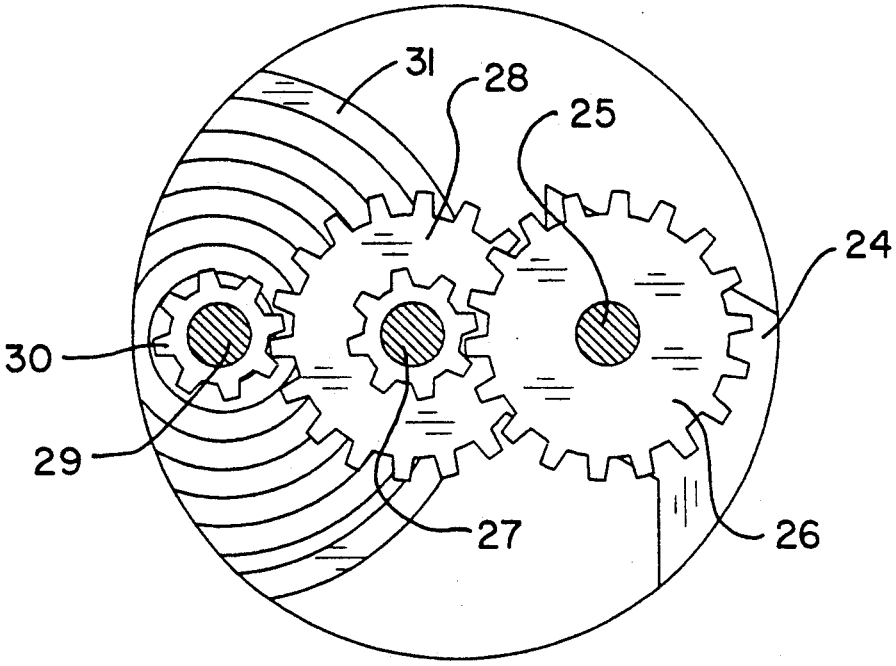
FIG. 6 is an enlarged view of section 6 as set forth in FIG. 5.

A plurality of parallel and coextensive slots 23 are directed into the cylindrical body 15 having wing plates 24, with a single wing plate 24 pivotally mounted in one of the slots 23, with each slot 23 positioned in alignment with one of the stabilizer fins 17. The body 15 includes a body cavity 15*a* receiving the wing plates, in a manner as indicated in FIG. 4. As to the FIG. 3, the wing plates 24 are pivotal from a first position received within the body cavity to a second extended position extending from the body cavity, wherein the wing plates in the first position are oriented at an acute included angle between the wing plates, wherein in a second position, the wing plates defined an obtuse included angle therebetween. Each of the slots 23 includes a wing plate pivot axle 25 pivotally mounting an associated wing plate within an associated slot. Each of the wing plate pivot axles 25 includes a wing plate pivot axle gear 26 (see FIGS. 5 and 6). A plurality of intermediate gear axles 27 are provided in a parallel relationship relative to the wing plate pivot axles 25, with each of the intermediate gear pivot axles 27 positioned interiorly of the cavity 15*a*, and each mounting an intermediate gear 28 in cooperation with an associated wing plate pivot axle gear 26. A central axle 29 is mounted medially of the intermediate gear axles 27 and the wing plate pivot axles 25, having a central gear 30 and a main spring 31 mounted to the central axles 29. The main spring is tensioned upon directing of the wing plates into the slots 23, and permits a slow released unwinding to project the wing plates from the slots to the second position, as indicated in FIG. 5, from the first position, as indicated in phantom.

Figure 7:
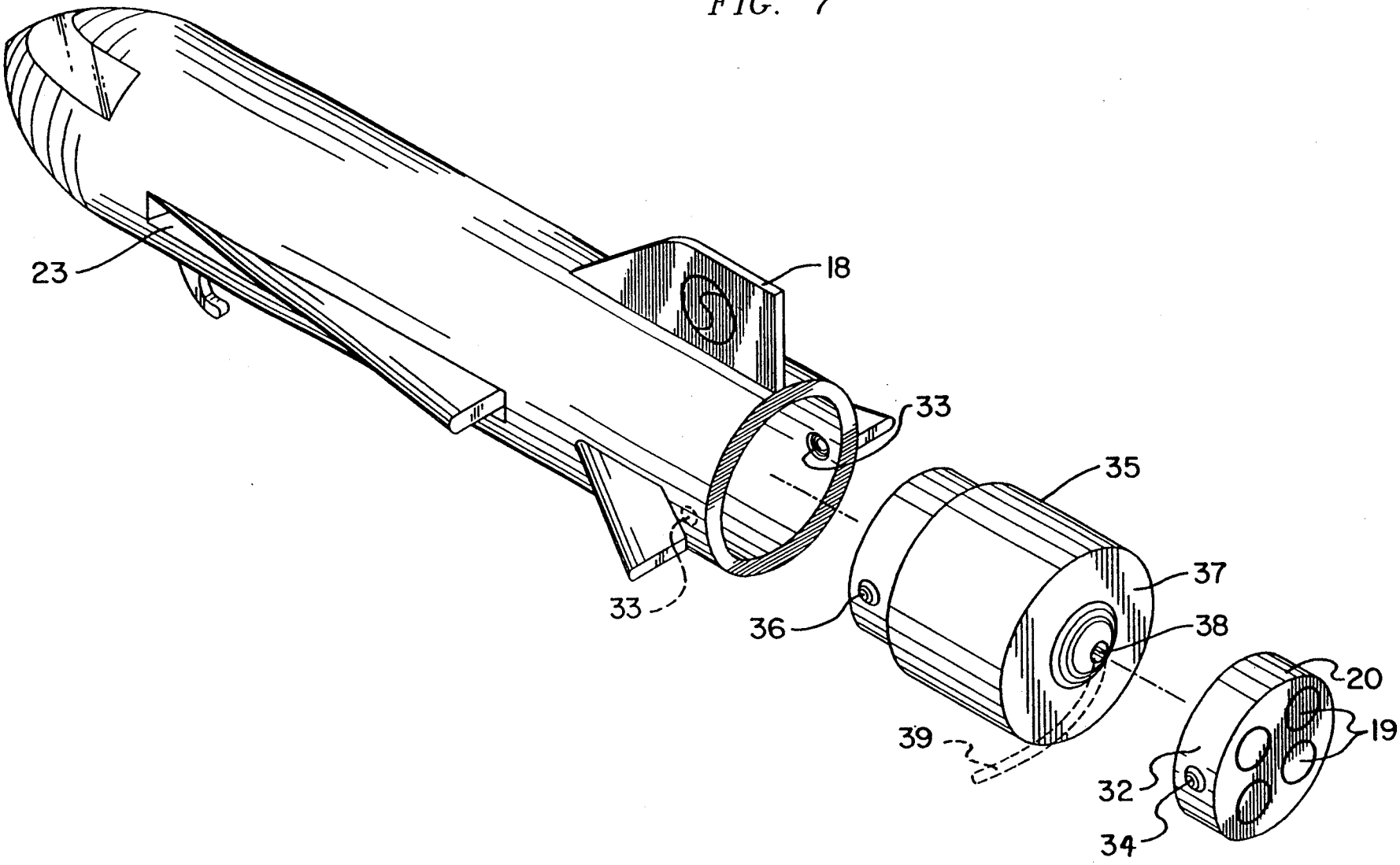
FIG. 7 is an isometric illustration of the projectile toy having a solid fuel canister mounted therewithin.

Reference to FIG. 7 indicates the removal of the cap 20 from the second end 16, wherein the second end 16 within the cavity includes a plurality of recesses 34 arranged to cooperate with the end cap projections 33 of the end cap skirt 32. The same recesses 34 are arranged to subsequently receive canister projections 36 of an associated solid fuel canister 35 that is ignited by directing a fuse 39 into the fuse opening 38 that upon burning of the fuse 39 within the opening 38 permits propulsion and directing of fuel gases through the opening 38.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A projectile toy apparatus, comprising, a projectile toy member having a cylindrical body, with the cylindrical body including a first end and a conical second end, with the conical second end and the first end coaxially aligned, and a plurality of stabilizer fins arranged in a coextensive relationship relative to one another mounted to the cylindrical body adjacent the first end in a diametrically opposed relationship, with a rudder fin mounted adjacent the first end on the cylindrical body medially of the stabilizer fins, and a hook member fixedly mounted to the cylindrical body medially of the stabilizer fins adjacent the second end, with a slingshot member having spaced slingshot legs, including an elastomeric band mounted to the slingshot legs, wherein the elastomeric band is arranged for securement to the hook member, and a plurality of parallel slots, with each of said slots arranged in alignment with one of said stabilizer fins, and the slots positioned intermediate the stabilizer fins and the second end, with each of the slots including a wing plate, and each wing plate includes a wing plate pivot axle, with each wing plate pivot axle positioned within one of said slots adjacent the second end, and the cylindrical body includes a body cavity, and the wing plates are pivotal from a first position defining an acute angle between the wing plates, wherein the wing plates are directed into the cavity, with the wing plates pivotal to a second position about each wing plate pivot axle, wherein the wing plates extend exteriorly of the cavity, and including an obtuse included angle between the wing plates, and each wing plate pivot axle includes a wing plate pivot axle gear, and each wing plate pivot axle includes an intermediate gear axle positioned within the cavity adjacent one of said wing plate pivot axles, and each intermediate gear axle includes an intermediate gear in operative engagement with one of said wing plate pivot axle gears, and a central axle intermediate the intermediate gear axles, with the central axle including a central axle gear, the central axle gear in engagement with each intermediate gear, and the central axle including a main spring arranged to bias the wing plates from the first position to the second position.

2. An apparatus as set forth in claim 1 wherein the first end includes a plurality of recesses positioned in adjacency to the second end, and a solid fuel canister, the solid fuel canister including an elongate body, and the solid fuel canister including a plurality of canister projections mounted to the canister body and the projections are arranged for reception within the recess permitting mounting of the solid fuel canister to the cylindrical body adjacent the first end.

* * * * *